US006159060A

United States Patent [19]

Purnell et al.

[11] Patent Number: 6,159,060

[45] Date of Patent: Dec. 12, 2000

[54] PROTECTIVE SHROUDING WITH DEBRIS DIVERTING INFLOW VANES FOR PUMP-JET PROPULSION UNIT

[75] Inventors: John G. Purnell, Catonsville; Alan J. Becnel, Annapolis, both of Md.

[73] Assignee: The United States of America as represented by the Secretary of the Navy, Washington, D.C.

[21] Appl. No.: 09/366,643

[22] Filed: Aug. 4, 1999

[51] Int. Cl.[7] ..... B63H 11/01

[52] U.S. Cl. ..... 440/46; 440/66

[58] Field of Search ..... 440/67, 46, 71, 440/72, 89

[56] References Cited

U.S. PATENT DOCUMENTS 4,427,393 1/1984 May ..... 440/71

4,680,017 7/1987 Eller ..... 440/71

5,928,042 7/1999 Quiggins ..... 440/72

5,954,554 9/1999 Bates ..... 440/89

*Primary Examiner*—Jesus D. Sotelo

*Attorney, Agent, or Firm*—John Forrest; Jacob Shuster

[57] ABSTRACT

A pump-jet type of outboard propulsion unit within a surrounding fluid medium for marine craft or the like, is protectively enclosed within cylindrical shrouding which forms an axial flow passage about the exhaust channel of the propulsion unit through which flow of the fluid medium is induced by rotation of impeller blades. Inflow of the fluid medium to the flow passage is modified at an inlet end of the shrouding by a plurality of angularly spaced vanes attached thereto and extending forwardly therefrom at an angle.

3 Claims, 5 Drawing Sheets

PROTECTIVE SHROUDING WITH DEBRIS DIVERTING INFLOW VANES FOR PUMP-JET PROPULSION UNIT

The present invention relates in general to enhancing the performance of pump-jet types of propulsion units within a fluid medium such as seawater or the like.

BACKGROUND OF THE INVENTION

Outboard motor propeller units currently utilized for propulsion of marine craft within seawater are a danger to swimmers and aquatic animals. Such motor propeller units have therefore been replaced by pump-jet types of propulsion units having impeller blading protectively enclosed within shrouding with flow directing vanes therein for guiding impeller induced outflow of the seawater to effect marine craft propulsion. However, such pump-jet propulsion units are adversely affected by floating debris and vegetation in the seawater drawn into the flow passage enclosed by the shroud structure, causing impact damage to the impeller blading and diminishing performance of the propeller unit because of impeller flow blockage. It is therefore an important object of the present invention to render such pump-jet type of propulsion unit arrangements more advantageous as a replacement for the outboard motor propeller units, less susceptible to damage and diminished performance because of seawater debris and vegetation.

SUMMARY OF THE INVENTION

In accordance with the present invention, the inflow end of the shrouding enclosing the impeller blading portion of a pump-jet type of propulsion unit has a plurality of debris diverting vanes externally attached thereto in angular spaced relation to each other and extending forwardly therefrom at an angle onto the casing of the rotor gear case portion of the pump-jet propulsion unit forwardly of the exhaust channel portion. Inflow of seawater into the annular passage enclosed by the shrouding is accordingly confined to the angular spacing between the debris diverting vanes so as to bar inflow of oversize debris and vegetation capable of producing troublesome impeller blade impact damage. Also, snaring of debris on such vanes is minimized because of its angular disposition forwardly and externally of the shrouding.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein.

Figure 1:
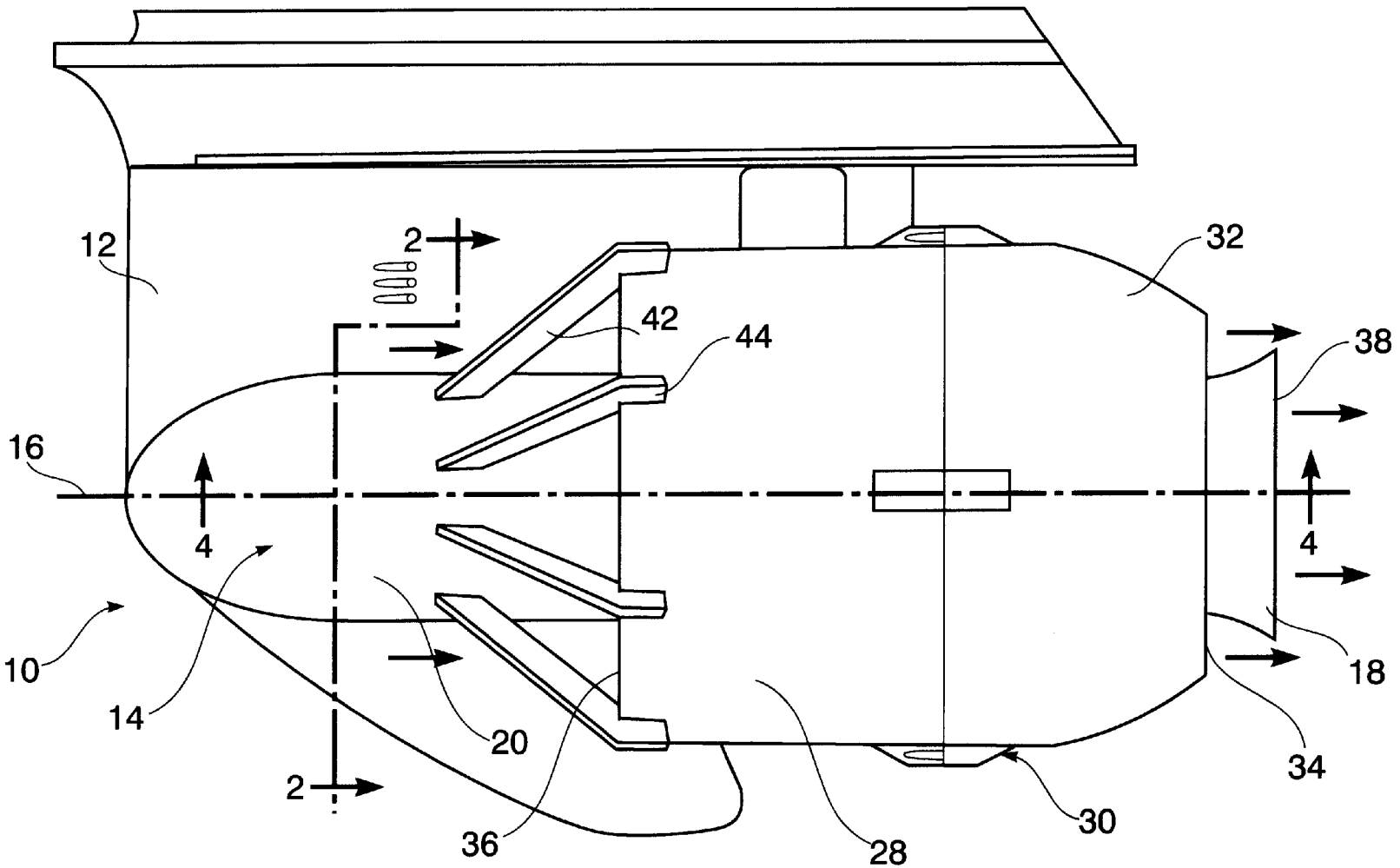
FIG. 1 is a side elevation view of a marine craft attached pump-jet type of propulsion unit with an inflow modifying protective arrangement in accordance with one embodiment of the present invention.
Figure 3:
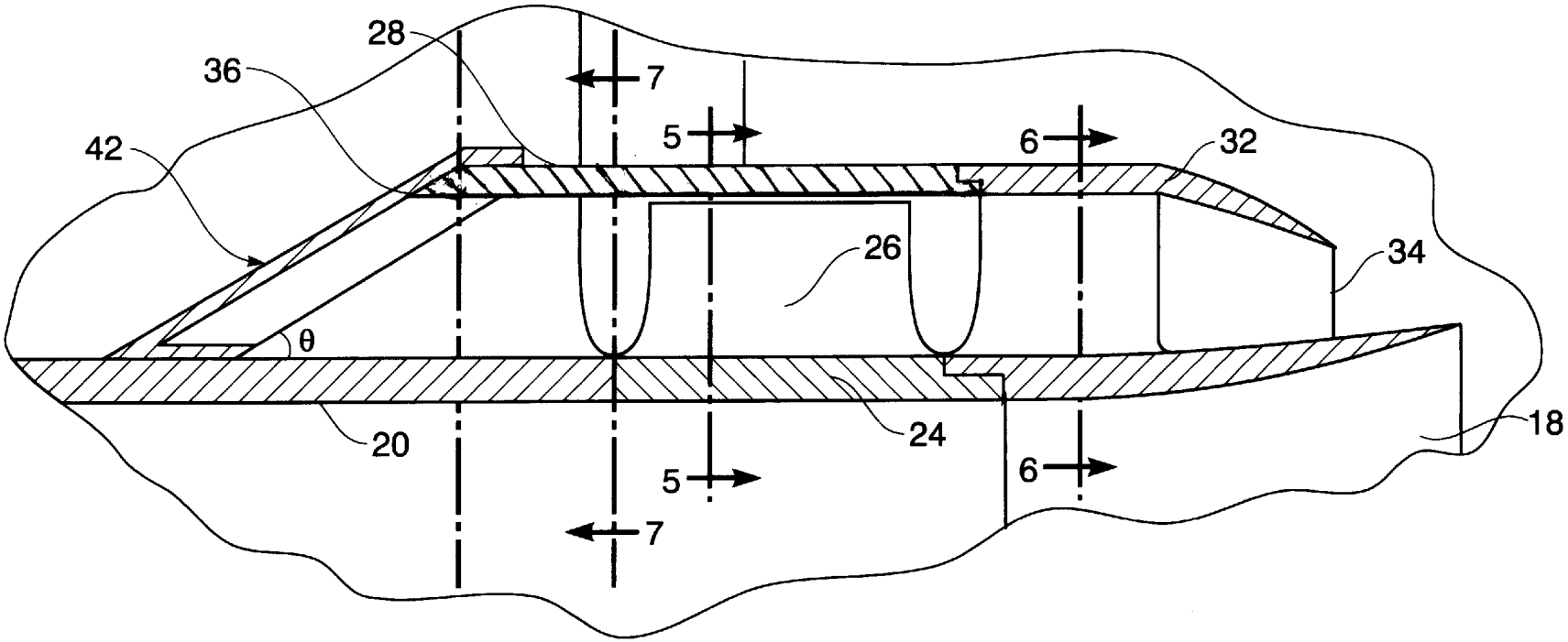
FIG. 3 is a partial section view taken substantially through a plane indicated by section line 3—3 in FIG. 2.
Figure 4:
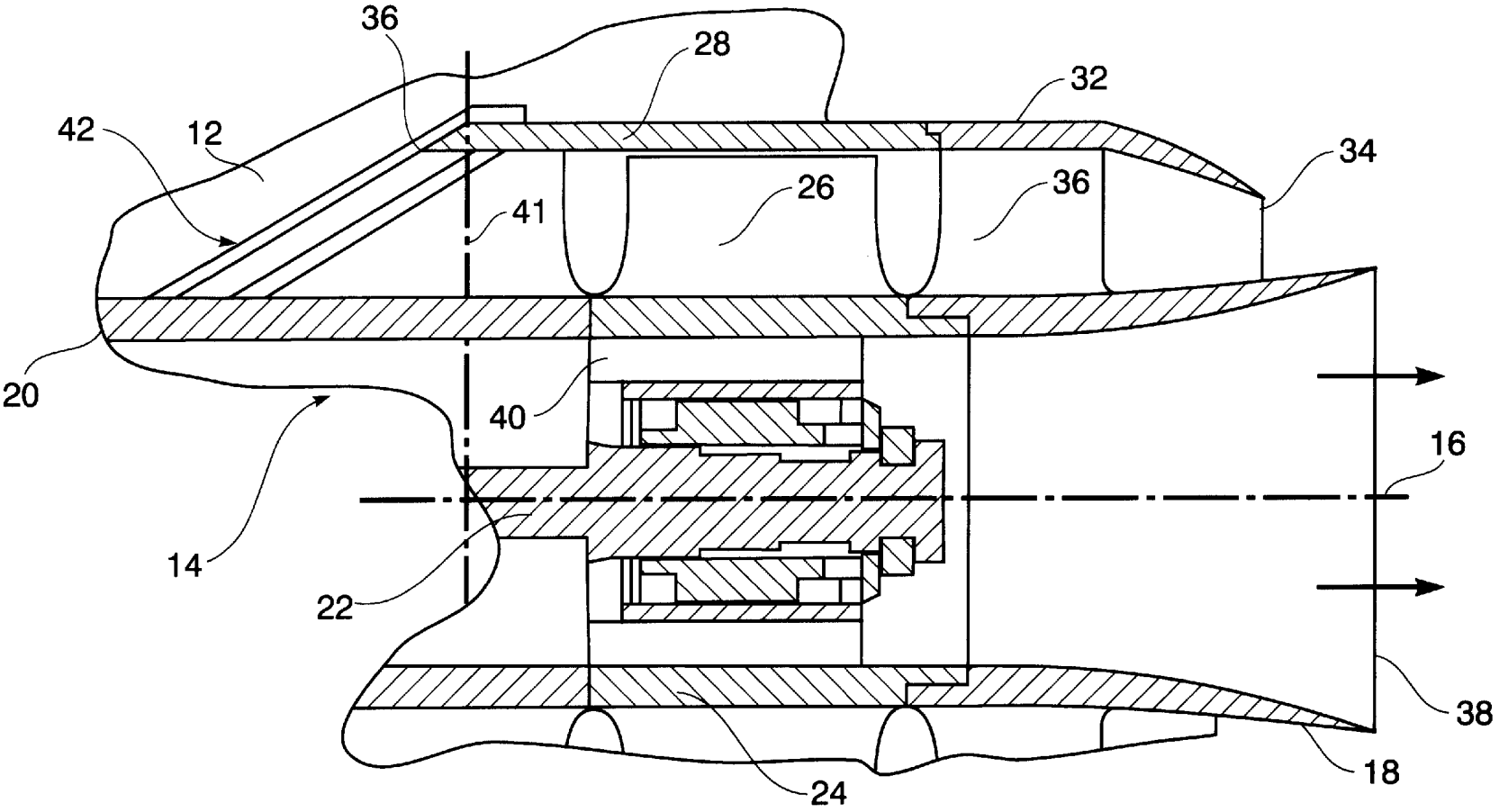
Figure 5:
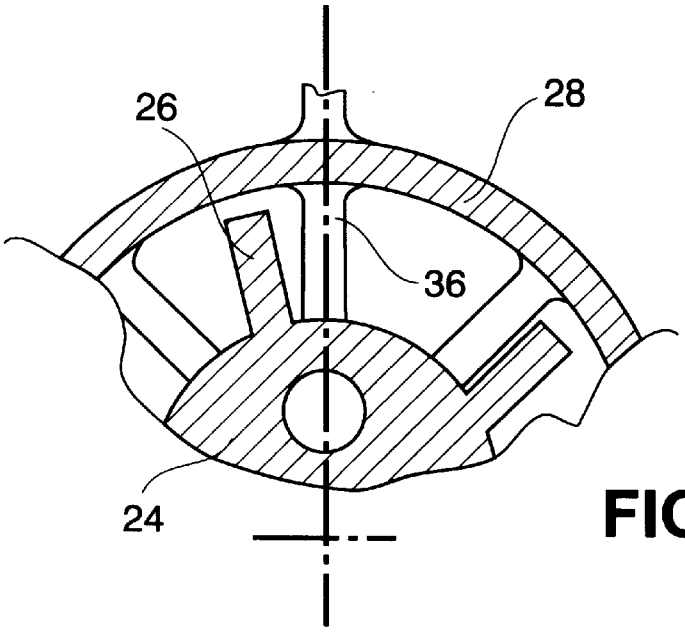
Figure 6:
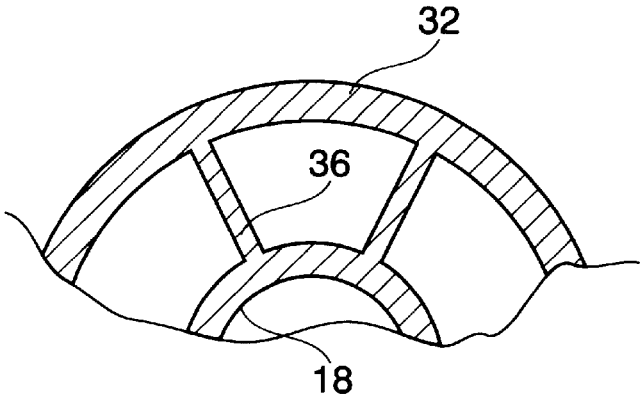
Figure 7:
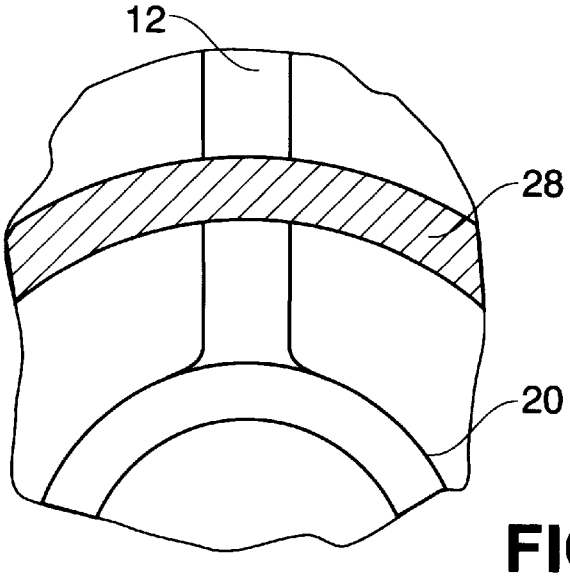

FIG. 4 is a partial section view taken substantially through a plane indicated by section line 4—4 in FIG. 1; and FIGS. 5, 6 and 7 are partial transverse section views taken substantially through planes respectively indicated by section lines 5—5, 6—6 and 7—7 in FIG. 3.

DETAILED DESCRIPTION OF PREFERRED EMBODIMENT

Referring now to the drawing in detail, FIG. 1 illustrates a pump-jet type of outboard propulsion unit 10 adapted to be mounted on a marine craft or the like through a vertical support 12 projecting upwardly therefrom. The propulsion unit 10 which is generally known in the art, includes a lower gearcase portion 14 connected to the support 12 for extension from its forward end along a rotational axis 16 in the direction of marine craft travel. The unit 10 terminates in rearwardly spaced relation to the support 12 along the axis 16 at an exhaust channel portion 18 in axial alignment with the gearcase portion 14.

As shown in FIG. 4, a cylindrical casing 20 of the pump-jet gearcase 14, fixed to the support 12, has an impeller drive shaft 22 extending rearwardly therefrom along the axis 16 into a cylindrical rotor 24 from which a plurality impeller blades 26 extend radially into close spaced relation to the inner surface of a cylindrical rotor enclosing shroud 28 fixed to the support 12. Such shroud 28 extends rearwardly along the axis 16 as shown in FIGS. 3, 4 and 5. At its rear axial end, the rotor shroud 28 is connected by a plurality of circumferentially spaced peripheral fastener assemblies 30 as shown in FIG. 1 to a cylindrical nozzle-stator shroud 32 having a rear exit end 34 from which the exhaust channel portion 18 of the propulsion unit 10 projects. A plurality of radial stator blades 36 interconnect the exhaust channel portion 18 with the nozzle-stator shroud 32, as shown in FIGS. 4 and 6.

As shown in FIGS. 1, 3 and 4, the rotor and stator shrouds 28 and 32 form an annular flow passage about the casing 20, the rotor 24 and the exhaust channel 18 of the propulsion unit 10 through which axial flow of the ambient fluid medium is induced by rotation of the impeller blades 26. Such flow of the fluid medium is conducted from an inflow inlet end 36 of the rotor shroud 28 to the nozzle exit end 34 of the nozzle-stator shroud 32, spaced forwardly of the discharge end 38 of the exhaust channel portion 18 of the propulsion unit. Exhaust gases passing through the propulsion unit 10 during drive of the shaft 22 causing rotation of the rotor 24 and the impeller blades 26 thereon, is accordingly conducted through the exhaust passage 40 within the rotor 24 for discharge through the exhaust channel 18. The impeller blades 26 thus act as a pump to induce inflow of the ambient fluid medium, such as seawater, into the inlet end 36 of the annular flow passage enclosed within the radially outer shrouds 28 and 32. Propulsion through the ambient fluid medium is thereby induced in response to discharge of the ambient fluid medium from the exit end 34 of the stator-nozzle shroud 32.

Figure 2:
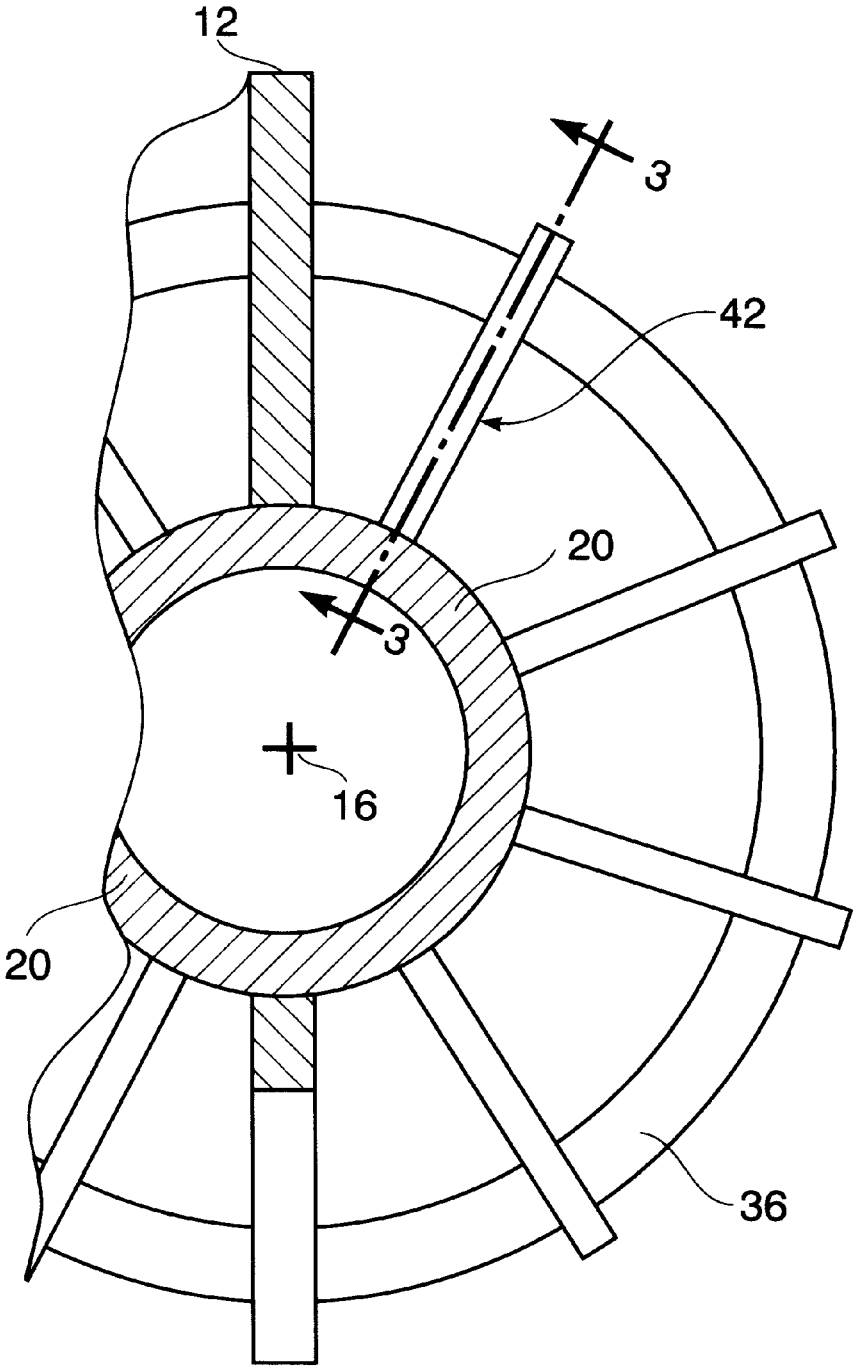
FIG. 2 is a partial transverse section view taken substantially through a plane indicated by section line 2—2 in FIG. 1.

In accordance with the present invention, the inlet end 36 of the annular flow passage on the rotor shroud 28, disposed in a plane 41 perpendicular to the axis 16 of the propulsion unit 10 as designated in FIG. 4, has a plurality of inflow modifying vanes 42 (such as four on each side of the support 12), as shown in FIGS. 1 and 2. Each of such vanes 42, attached at their upper ends to the shroud 28 at its inlet end 36, extends forwardly from the inlet plane 41 into abutment with the casing 20 at slope angle $\theta$ to the axis 16 of 45° or less as indicated in FIG. 3. Inflow into the inlet end of the annular flow passage is thereby modified by confinement to the angular spacing between the vanes 42, as shown in FIG. 2. Such arrangement and disposition of the vanes 42 will accordingly affect inflow by diverting, obstructing or filtering out objectionable debris and vegetation within the ambient fluid medium of a size capable of imposing damage and/or significantly reducing performance of the pump-jet type of propulsion unit 10 involved. Thus, in addition to isolating the impeller blades 26 from possible injurious contact with swimmers or contact with aquatic mammals in seawater, ingestion of oversize debris and vegetation is also avoided to prevent impeller impact damage and reduced performance. As also shown in FIG. 3, each of the vane 42 may be replaceably attached through tabs 44 externally to the top of the shroud 28 adjacent to its inlet end 36, from which the vanes extend forwardly at an angle to the casing 20, thereby reducing the possibility of any debris or other matter being snared onto the shroud 28 at its inlet end 36.

Obviously, modifications and variations of the present invention may be possible in light of the foregoing teachings. It is therefore to be understood that within the scope of the appended claims the invention may be practiced otherwise than as specifically described.

What is claimed is:

1. In combination with a propulsion unit having impeller means for inducing flow of a fluid medium in response to rotation about a rotational axis and a rotationally fixed exhaust channel through which said rotational axis extends; the improvement residing in shroud means protectively enclosing the impeller means and the exhaust channel to form thereabout an annular flow passage through which said flow of said fluid medium is confined during said rotation of the impeller means; and inflow modifying means connected to the shroud means and extending forwardly therefrom along said rotational axis into the flow passage for deflecting debris within the fluid medium to prevent impact thereof with the impeller means within the annular flow passage formed about the impeller means and the rotationally fixed exhaust channel.

2. In combination with a propulsion unit having: impeller means for inducing flow of a fluid medium along a rotational axis and a rotationally fixed exhaust channel portion, said impeller means including a rotor in axial alignment with the exhaust channel portion and a plurality of angularly spaced impeller blades fixed to the rotor and extending radially therefrom; the improvement residing in shroud means completely enclosing the impeller means and the exhaust channel portion of the propulsion unit within an annular flow passage through which said flow of the fluid medium is induced by said rotation of the rotor; a plurality of debris diverting vanes extending forwardly from the shroud means in angularly spaced relation to each other at an angle to the rotational axis; and a plurality of angularly spaced stator blades within the annular flow passage fixedly interconnecting the exhaust channel portion with the shroud means in rearwardly spaced relation to the impeller blades along the rotational axis.

3. The combination as defined in claim 2 wherein said shroud means comprises a cylindrical enclosure positioned about the exhaust channel portion and the rotor and having an inlet end spaced forwardly thereof to which the debris diverting vanes are attached.

* * * * *